US005266999A

United States Patent [19]

Yashiro

[11] Patent Number: 5,266,999

[45] Date of Patent: Nov. 30, 1993

[54] PROCESS CARTRIDGE AND IMAGE FORMING APPARATUS FOR USE WITH THE SAME

[75] Inventor: Masahiko Yashiro, Yokohama, Japan

[73] Assignee: Canon Kabushiki Kaisha, Tokyo, Japan

[21] Appl. No.: 962,005

[22] Filed: Oct. 15, 1992

Related U.S. Application Data

[63] Continuation of Ser. No. 861,112, Mar. 31, 1992, abandoned.

[30] Foreign Application Priority Data

Apr. 1, 1991 [JP] Japan ..... 3-68484
Mar. 18, 1992 [JP] Japan ..... 4-62305

[51] Int. Cl.[5] ..... G03G 15/00
[52] U.S. Cl. ..... 355/211; 355/200
[58] Field of Search ..... 355/200, 210, 211; 346/160

[56] References Cited

U.S. PATENT DOCUMENTS

| | | | |
|---|---|---|---|
| 3,985,436 | 10/1976 | Tanaka et al. | 355/8 |
| 4,462,677 | 9/1984 | Onoda | 355/3 R |
| 4,875,077 | 10/1989 | Takamatsu et al. | 355/212 |
| 5,113,220 | 5/1992 | Kwak | 355/200 |
| 5,119,134 | 6/1992 | Haneda et al. | 355/200 X |
| 5,140,369 | 8/1992 | Haneda et al. | 355/210 |

FOREIGN PATENT DOCUMENTS

| | | | |
|---|---|---|---|
| 0389267A3 | 9/1990 | European Pat. Off. . | |
| 3220538A1 | 12/1982 | Fed. Rep. of Germany . | |
| 59-127073 | 7/1984 | Japan | 355/211 |
| 63-162267 | 1/1988 | Japan | 355/211 |
| 63-129356 | 6/1988 | Japan | 355/211 |
| 1-191861 | 8/1989 | Japan | 355/211 |
| 3-11368 | 1/1991 | Japan | 355/211 |

OTHER PUBLICATIONS

Patent Abstracts of Japan vol. 11, No. 291 (P-618) 19 Sep. 1987, For Japanese Patent Document 62-086370.

*Primary Examiner*—R. L. Moses
*Attorney, Agent, or Firm*—Fitzpatrick, Cella, Harper & Scinto

[57] ABSTRACT

The present invention provides a process cartridge removably mountable within an image forming system comprising an image bearing member, process means acting on the image bearing member, a protection member shiftable between a protection position where the protection member protects the image bearing member and a retracted position where the protection member is retracted from the protection position, and abutment means formed on a surface of the protection member which can face the image bearing member, wherein the abutment means is adapted to be abutted against a non-image forming area of the image bearing member.

34 Claims, 9 Drawing Sheets

PROCESS CARTRIDGE AND IMAGE FORMING APPARATUS FOR USE WITH THE SAME

This application is a continuation of application Ser. No. 07/861,112 filed Mar. 31, 1992, now abandoned.

BACKGROUND OF THE INVENTION

1. Field of the Invention

The present invention relates to a process cartridge and an image forming system or an image forming apparatus within which such process cartridge can be mounted. The image forming system may be an electrophotographic copying machine, a laser beam printer (LBP), a facsimile system, a word processor or the like.

2. Related Background Art

In the past, an image forming system having a removable process cartridge including a desired process means necessary for forming an image, thereby permitting the easy replacement of the cartridge due to the expiration of the service life of the cartridge or the like has been proposed (refer to U.S. Pat. No. 3,985,436). Further, a plurality of process cartridges having developers of different colors therein can be used to form a color image, and, thus, have a high frequency of exchange, and, in some cases, the process cartridge alone is disposed outside the image forming system. Under these circumstances, it is necessary to prevent the photosensitive member from being smudged or damaged and to prevent the photo member from being exposed to light (which leads to the deterioration of the photosensitive member). To this end, the process cartridge is provided with a cover member for protecting the photosensitive member and shielding the interior of the cartridge from ambient light.

Inventors invented the particularly effective techniques in this technical field and disclosed them in U.S. Pat. Nos. 4,470,689 and 4,462,677. The present invention relates to the improvement in the above invented techniques.

Now, the background art for the present invention, that is, art of the process cartridge, will be described with reference to FIGS. 1 to 3.

FIG. 1 shows a process cartridge 3. A photosensitive drum 4 disposed in the process cartridge 3 is easily overcome by shock and frictional wear. Thus, normally, a drum shutter 20 is provided at a transfer opening 3*a* of the cartridge 3 and the photosensitive drum 4 is protected by the drum shutter 20. Incidentally, when the cartridge is inserted into an image forming system, the drum shutter 20 is shifted from a closed position to an open position,(shown by the broken line 20*a*), thus permitting the transfer of an image formed on the photosensitive drum.

The closed position of the drum shutter is limited or regulated by abutting a projection 20*b* of the drum shutter against an end 7*a* of a cleaner 7. The reference numeral 21 denotes a shutter arm.

However, the width of the drum shutter 20 is long (for example, in a process cartridge 3 capable of forming an image on a sheet of A4 size, the width L is about 270 mm, and, in a process cartridge 3 capable of forming an image on a sheet of A3 size, the width L is about 350 mm). Further, the drum shutter 20 is generally formed from the engineering plastics. Thus, when the cartridge 3 is dismounted from the image forming system 2, if an operator grasps the process cartridge 3 by his hand as shown in FIG. 2A, a central portion of the shutter 20 will be flexed as shown in FIG. 2B. Accordingly, it was feared that the drum shutter 20 would contact with the photosensitive drum 4 (FIG. 2B), thus damaging the latter. To avoid this, as shown in FIG. 3, a protection sheet as a drum guard 23 for protecting the drum is adhered to an inner surface of the drum shutter 20 to protect the drum. However, even in this case, it is difficult to completely prevent damage of the photosensitive drum 4 due to contact between the drum and the drum shutter 20.

SUMMARY OF THE INVENTION

An object of the present invention is to provide a process cartridge and an image forming system within which such process cartridge can be mounted which can maintain the image quality.

Another object of the present invention is to provide a process cartridge and an image forming system which can prevent an image bearing member from being damaged by a protection member for protecting the image bearing member.

A further object of the present invention is to provide a process cartridge and an image forming system wherein, even if the cover of the drum shutter is deformed by an operator's hand, an image bearing member such as a photosensitive drum is not contacted with the cover, thus protecting the image bearing member.

Another object of the present invention is to provide a process cartridge and an image forming system which comprises a cover shiftable between a first position where it covers an exposed surface of an image bearing member and a second position where it is retarded from the first position, wherein, when the cover is positioned in the first position, the cover is abutted against a non-imaging area of the image bearing member (including a flange fixed to the image bearing member), thus regulating the position of the cover.

BRIEF DESCRIPTION OF THE DRAWINGS

FIG. 2A is a side view of a process cartridge grasped by an operator's hand, and FIG. 2B shows a relation between a photosensitive member and a drum shutter;

FIG. 7A is a perspective view of the process cartridge and FIG. 7B is an end view of the process cartridge;

FIG. 8A is a perspective view of the process cartridge and FIG. 8B is an end view of the process cartridge;

DETAILED DESCRIPTION OF THE PREFERRED EMBODIMENTS

The present invention is applicable to an image forming system such as an electrophotographic system, an electrostatic recording system or the like which an electrophotographic technique and which can be embodied as an electrophotographic copying machine, a laser beam printer or the like.

First of all, as an example of an image forming system, a compact laser beam printer used as an output device for an information processing system will be explained.

Figure 4:
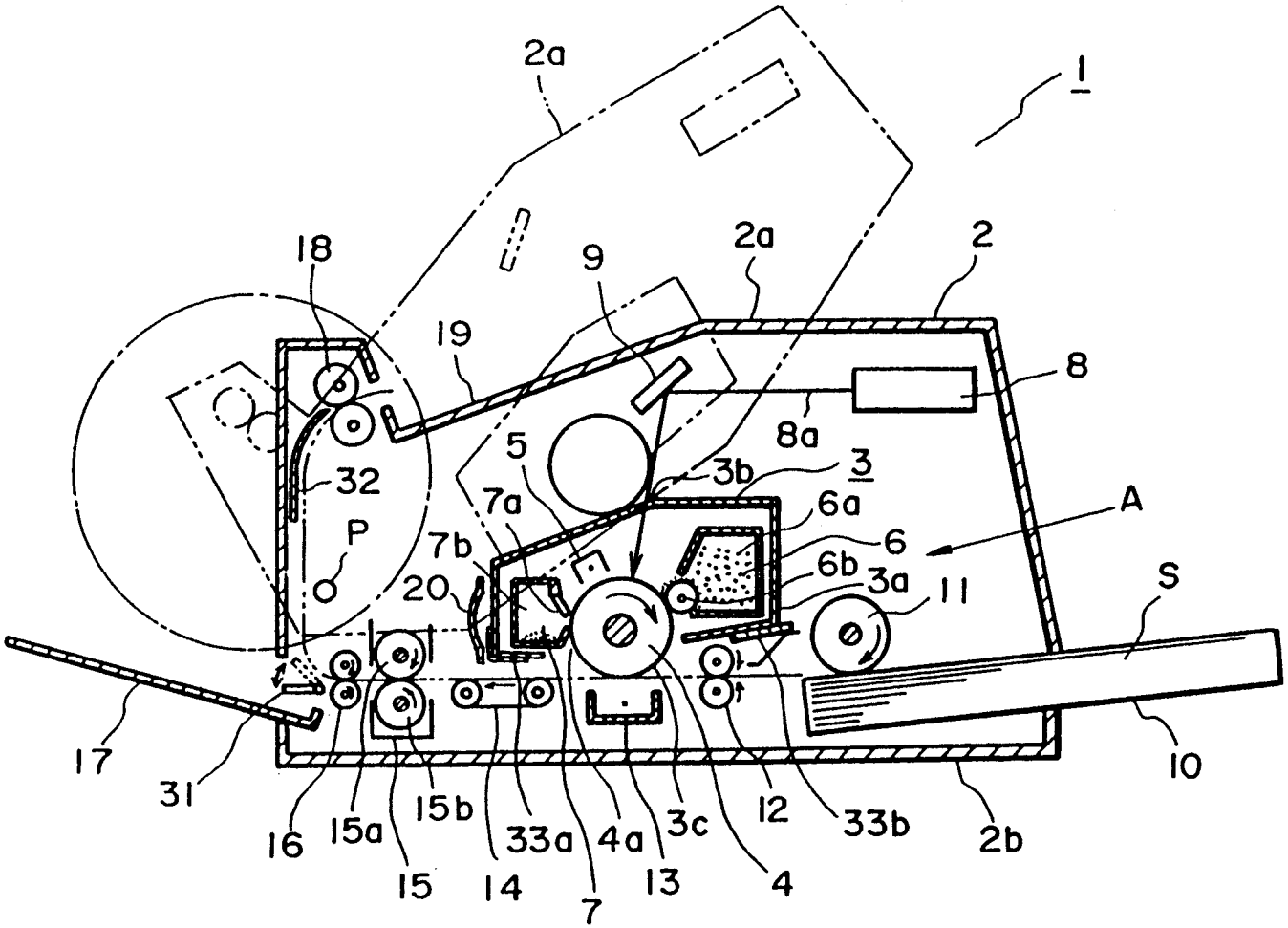
FIG. 4 is an elevational sectional view of a laser beam printer according to a preferred embodiment of the present invention.

As shown in FIG. 4, a laser beam printer 1 includes a process cartridge 3 removably mounted within a frame 2 of the printer. The process cartridge 3 has a frame 3*a* within which there are arranged a photosensitive drum 4 acting as an image bearing member, and a conventional process means comprising a charger 5, a developing device 6 (including a toner containing portion 6*a* and a developing sleeve 6*b*) and a cleaner 7 (including a cleaning blade 7*a* and a waste toner reservoir 7*b*) which are disposed around the photosensitive drum. Incidentally, the reference numerals 33*a* and 33*b* denote cartridge mounting means on which the process cartridge 3 can be mounted from a direction shown by the arrow A. Further, within the frame 2 of the printer at an upper portion thereof, there are arranged a scanner unit 8 for emitting a laser beam 8*a* onto a photosensitive member 4*a* of the drum and scanning the drum, and a reflection mirror 9. The scanner unit 8 receives image information from an information processing system (not shown) such as a computer or a word processor and emits the laser beam 8*a* in correspondence to the information.

When the photosensitive drum 4 uniformly charged by the charger 5 is scanned by the laser beam 8*a*, a latent image corresponding to the image information is formed on the drum. The latent image is developed by the developing device 6 to form a toner image. Within a lower portion of the frame 2, there is disposed a sheet supply cassette 10 containing sheets (recording media) S therein. A sheet supply roller 11 is arranged above the sheet supply cassette 10. The sheets S contained in the sheet supply cassette 10 are supplied one by one by means of the sheet supply roller 11 and conveyed to a pair of regist rollers 12 which in turn position the sheet between the photosensitive drum 4 and a transfer charger 13 in correspondence with the toner image formed on the photosensitive drum 4. Then, the toner image on the photosensitive drum 4 is transferred onto the sheet S at a transfer station. The sheet to which the image is transferred is sent, by a convey belt unit 14, to a fixing device 15 (including a heat roller 15*a* and a pressure roller 15*b*), where the toner image is permanently fixed to the sheet. Thereafter, the sheet is ejected out of the frame 2. Incidentally, the frame 3*a* of the cartridge has an exposure opening 3*b* and a transfer opening 3*c* and supports the photosensitive drum 4, developing device 6 and cleaner 7.

In the laser beam printer 1 according to the illustrated embodiment, there are two methods for ejecting the sheet S after the image formation, one of which is a method for ejecting the sheet S face-up, i.e., with the imaged surface facing up. In this case, the sheet S is sent by face-up ejector rollers 16 toward a face-up ejection tray 17. The other method for ejecting the sheet is a method for ejecting sheet S with face-down, i.e., with the imaged surface facing. In this case, the sheet S fed from the face-up ejector rollers 16 is guided upwardly via a switching means 31 such as a flapper and a sheet guide member 32 to invert the sheet, and then is ejected onto a face-down ejection tray 19 via face-down ejector rollers 18. Incidentally, the switching means 31 may be automatically switched by the activation of a plunger (not shown) when an operator turns a switch button (not shown) ON or may be manually switched by manipulating a manual lever (not shown).

Further, the maintenance of the laser beam printer 1 according to the illustrated embodiment (for example, jam treatment or the replacement of the process cartridge) is effected form a direction shown by the arrow A after an upper portion 2*a* of the frame 2 is rotated upwardly with respect to a lower portion 2*b* around a pivot P to expose the interior of the printer. Incidentally, the process cartridge 3 is mounted on the upper portion 2*a*.

Next, the process cartridge according a first embodiment of the present invention will be explained. Incidentally, in the embodiment described hereinbelow, the constructural elements having the same functions as those in the aforementioned embodiment are designated by the same reference numerals.

Figure 5A:
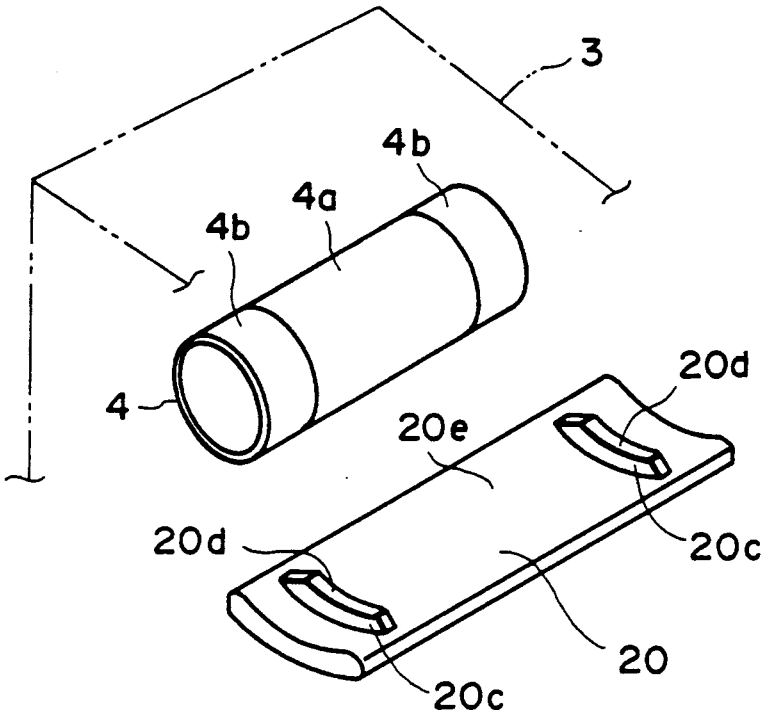
FIG. 5A is a perspective view of a process cartridge according to a first embodiment of the present invention.
Figure 5B:
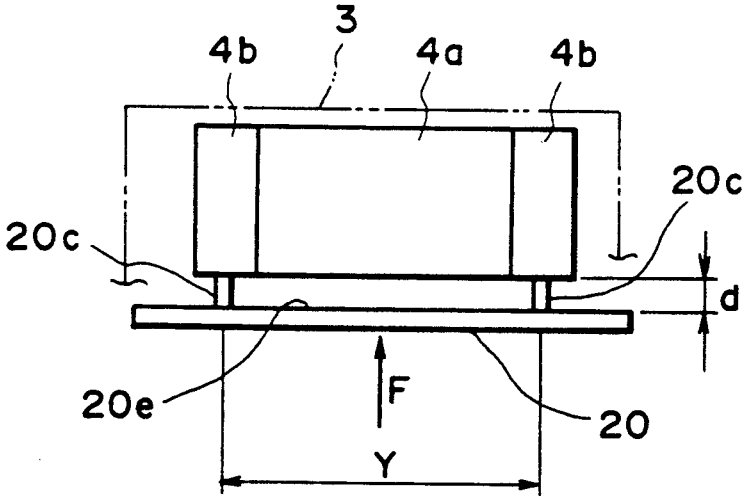
FIG. 5B is a side view of the process cartridge.

FIGS. 5A and 5B show the process cartridge according to the first embodiment of the present invention, where FIG. 5A is a perspective view of the process cartridge and FIG. 5B is a side view of the cartridge.

In this embodiment, two ribs 20*c* are formed on an inner surface 20*e* of a drum shutter 20 as a cover (surface facing the photosensitive drum 4 when the shutter is in a closed position) near both ends thereof along a width thereof (i.e., along the opening/closing direction of the shutter), so that the ribs are abutted against the photosensitive drum (image bearing member) 4 when the shutter is closed. In this case, the position of the ribs 20*c* is so selected that they are abutted against non-imaging areas or non-photosensitive surface (cylindrical peripheral surfaces) 4*b* disposed on both ends of the drum, thus preventing the ribs from contacting with a photosensitive surface (imaging area) 4*a* of the drum. That is to say, according to this embodiment, the ribs 20*c* are protruded from the drum shutter 20 towards the drum at areas out of the photosensitive surface or imaging area 4*a*. Incidentally, the ribs 20*c* have semi-cylindrical surfaces 20*d* adapted to be smoothly abutted against the photosensitive drum 4. Further, the areas of the photosensitive drum 4 against which the ribs 20*c* are abutted are not limited to the non-photosensitive surfaces, but may be photosensitive surfaces on which an image is not formed. Furthermore, the ribs 20*c* ar e protruded from the inner surface 20*e* of the drum shutter 20 by about 3–7 mm, preferably about 4–6 mm an most preferably about 5.5 mm.

In FIG. 5B, when a flexed amount of the drum shutter 20 at loading points (normally, load of about 2 Kg) generated by forces F due to the operator's grasp of the process cartridge 3 is $\delta$, the height d of each rib 20*c* may be selected so that the height d becomes greater than the flexed amount $\delta(d>\delta)$. With this arrangement, even if the drum shutter 20 is flexed, it does not contact with the photosensitive surface 4*a*, thus preventing the damage of the photosensitive surface 4a. Further, in the illustrated embodiment, although the ribs 20c on both ends of the drum shutter 20 are abutted against the nonphotosensitive surfaces 4b, since such surfaces are out of the image forming area, if such surfaces are damaged, the image to be formed is not influenced by such damage. Furthermore, the ribs 20c may be abutted against the portions of the photosensitive surface 4a so long as such portions are non-imaging areas. Also in this case, the image to be formed is not influenced badly.

Further, because of $d > \delta$, a protection sheet is not required, thus reducing the cost of the cartridge. Furthermore, since the drum shutter is directly positioned with respect to the photosensitive drum 4, the positioning accuracy of the drum shutter is improved, thus enhancing the protecting ability of the drum shutter 20 regarding the photosensitive drum 4.

Figure 6A:
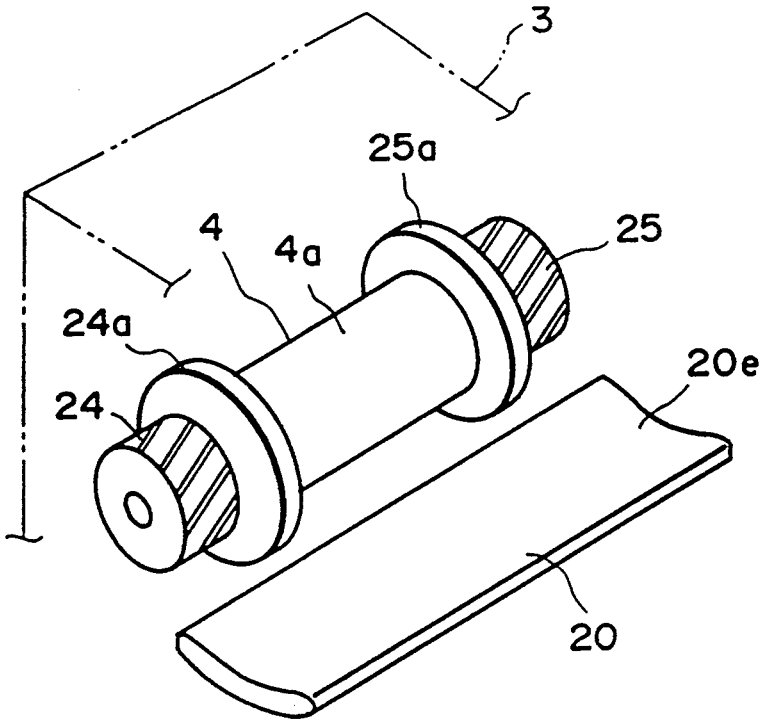
FIG. 6A is a perspective view of a process cartridge according to a second embodiment of the present invention.
Figure 6B:
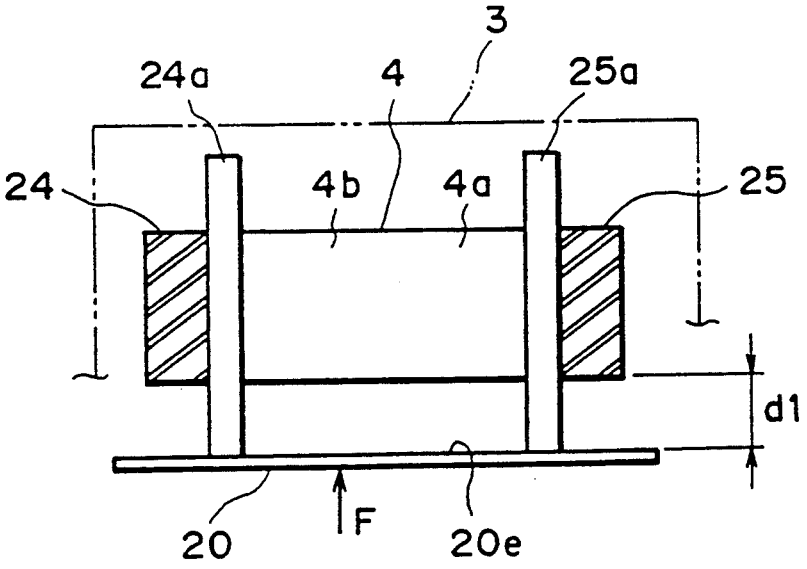
FIG. 6B is a side view of the process cartridge.

Next, FIGS. 6A and 6B show a process cartridge according to a second embodiment of the present invention, where FIG. 6A is a perspective view of the process cartridge and FIG. 6B is a side view of the cartridge.

In this embodiment, flanges 24a, 25a having drum gear portions 24, 25 are adhered to or press-fitted into an inner cylindrical surface of the cylinder 4b and each has an outer diameter sufficiently larger than the outer diameter of the photosensitive drum 4 and tip circles of the drum gear portions 24, 25. Outer surfaces of the flanges 24a, 25a are adapted to be abutted against an inner surface 20e of a drum shutter 20. In this case, when the height $d_1$ of each flange is so selected to be greater than the above-mentioned flexed amount $\delta(d_1 > \delta)$, it is possible to obtain the same technical effect as that of the first embodiment. Incidentally, for example, the gear portion 24 serves to receive a driving force for driving the photosensitive drum 4 from the printer 1 and the gear portion 25 serves to drive the developing sleeve 6b and the like.

Further, such flanges 24a, 25a serve to prevent the toner adhered to the photosensitive drum 4 from scattering on and adhering to surfaces of teeth or grooves of the drum gear portions 24, 25, thus reducing discrepancy in the gearing. Further, when any lubricant is applied to the gearing portions to obtain smooth gearing, the flanges 24a, 25a can prevent the lubricant from flowing from the gear portions onto the photosensitive drum 4.

Incidentally, in the above-mentioned conditions shown in FIGS. 5B and 6B, the drum shutter 20 covers the exposed area (transfer area) of the photosensitive drum 4; whereas, when the process cartridge 3 is inserted into the printer, the drum shutter 20 is retarded from this position.

In this embodiment, the drum shutter 20 is integrally formed from high impact plastic resin such as polystyrol, and the thickness thereof is about 0.5–3 mm, preferably about 1–2 mm and most preferably about 1.5 mm.

Figure 7A:
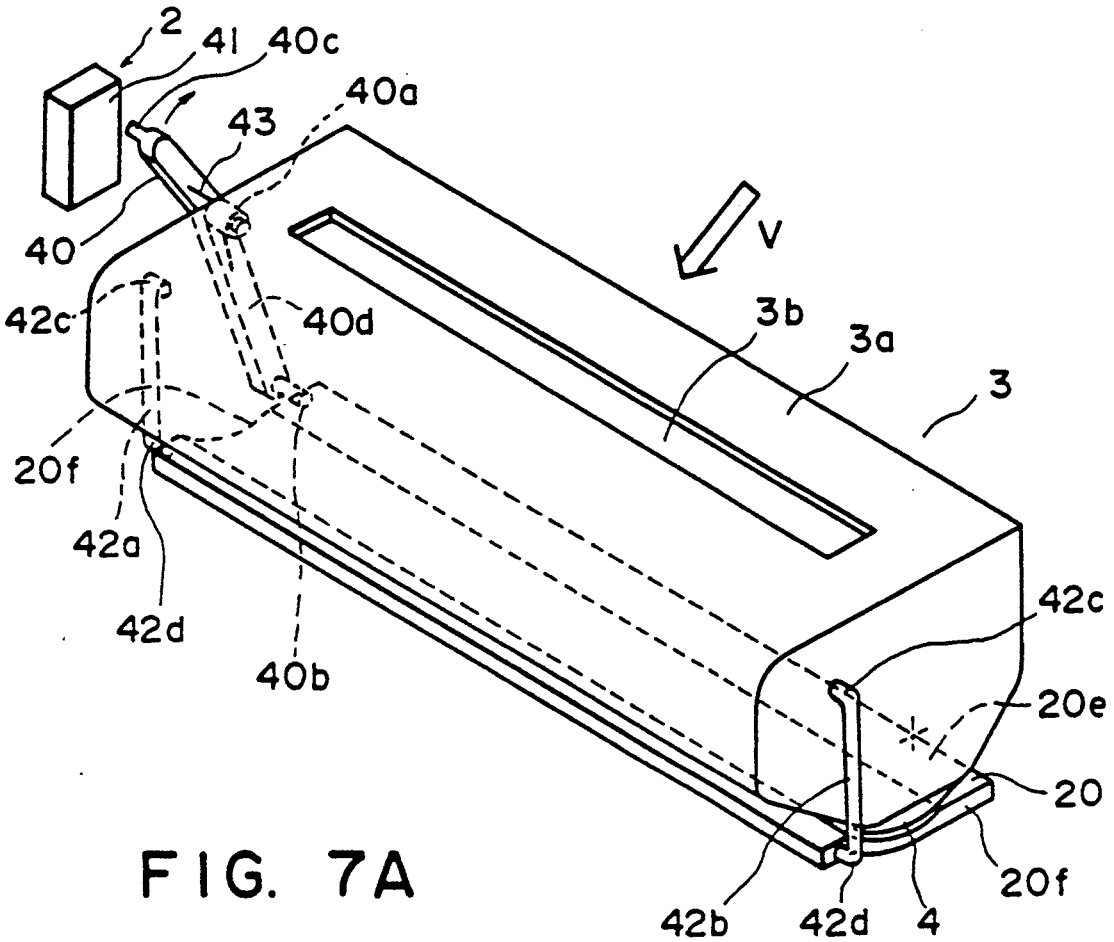
FIGS. 7A and 7B are views showing a process cartridge according to the present invention in the condition that it is starting to be inserted into an image forming system, where
Figure 7B:
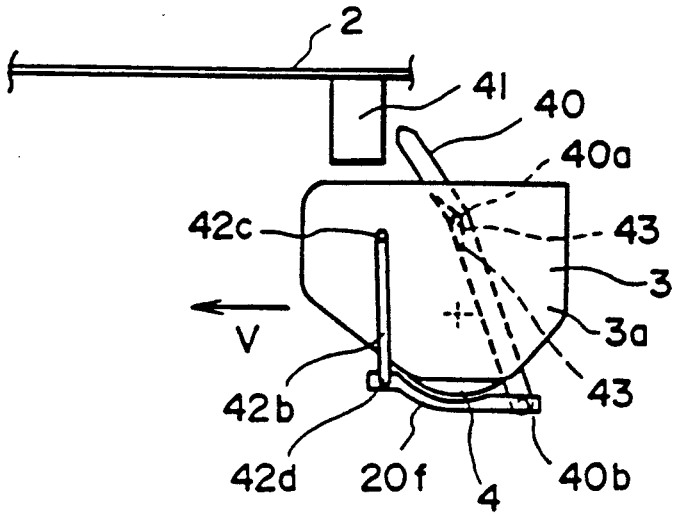
Figure 8A:
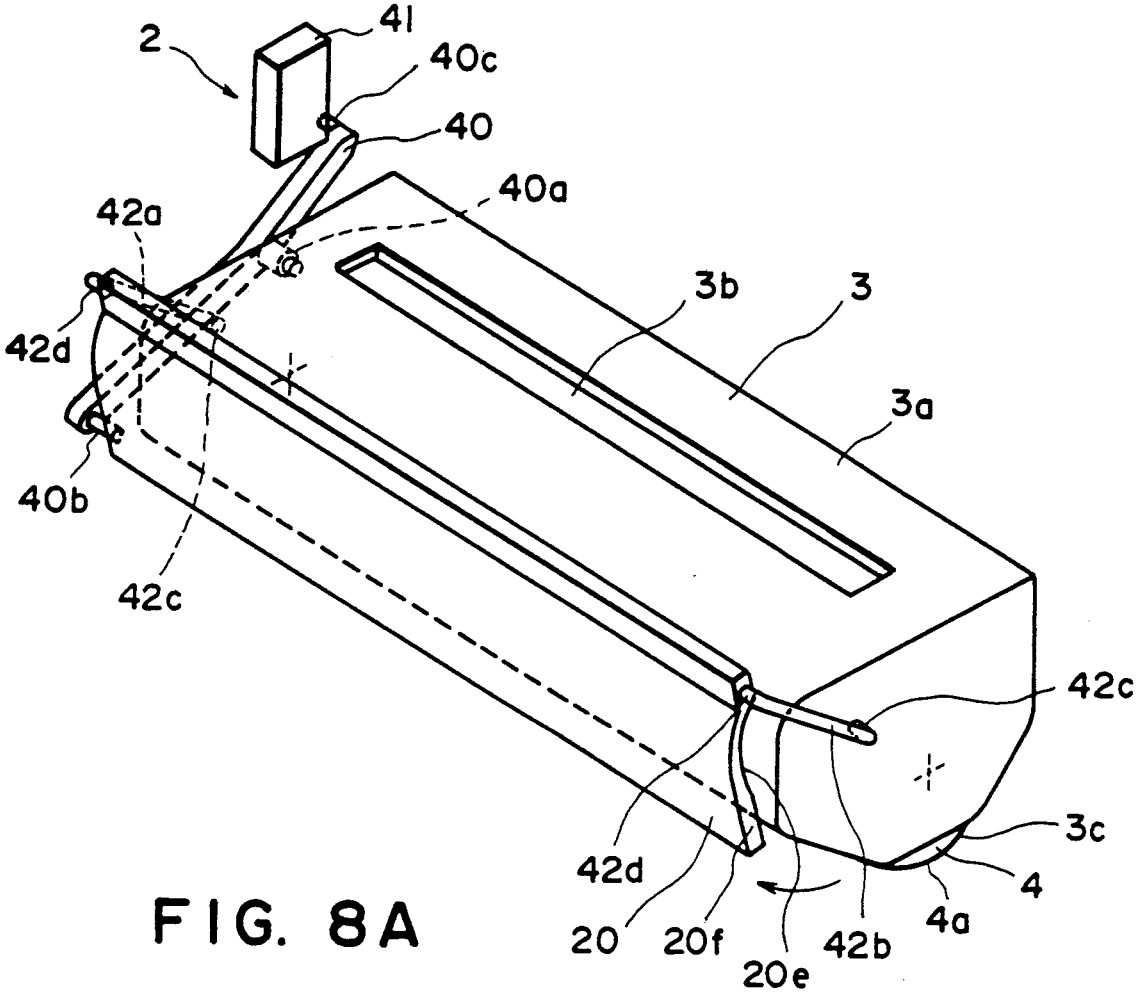
FIGS. 8A and 8B are views showing the process cartridge in a condition after it is completely inserted into the image forming system, where
Figure 8B:
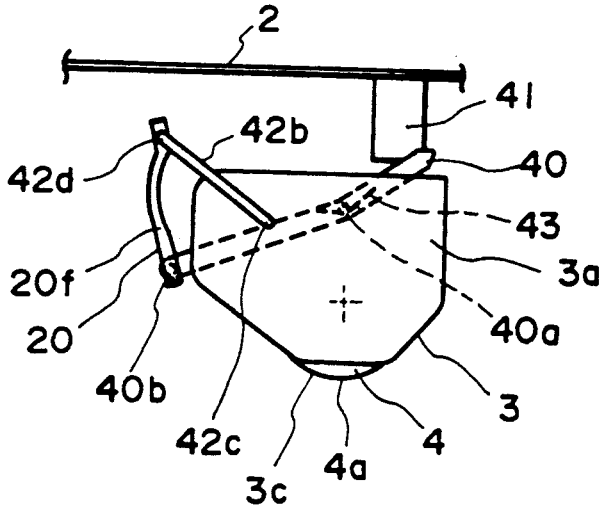

Next, an opening/closing mechanism for the drum shutter 20 during the mounting and dismounting of the process cartridge 3 with respect to the frame 2 of the printer will be explained with reference to FIGS. 7 and 8. Incidentally, FIGS. 7A and 7B show a condition where the process cartridge 3 is starting to be inserted into the frame 2 of the printer, where FIG. 7A is a perspective view of the process cartridge and FIG. 7B is a side view of the cartridge. Further, FIGS. 8A and 8B show a condition where the process cartridge 3 is completely inserted into the frame 2 of the printer, where FIG. 8A is a perspective view of the process cartridge and FIG. 8B is a side view of the cartridge. Incidentally, the reference numeral 3b denotes an exposure opening through which the light corresponding to the image information is emitted onto the photosensitive member 4a.

Figure 1:
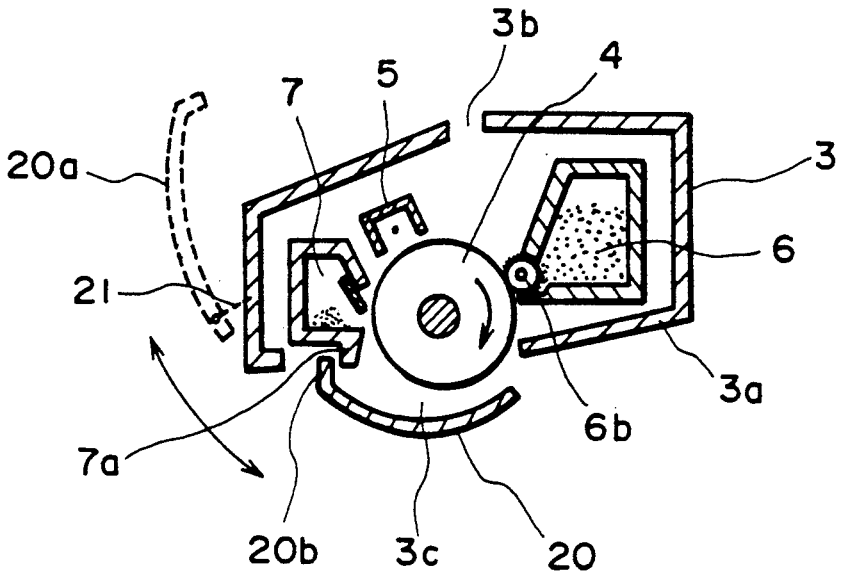
FIG. 1 is a side sectional view of a process cartridge for explaining the background art for the present invention.
Figure 2A:
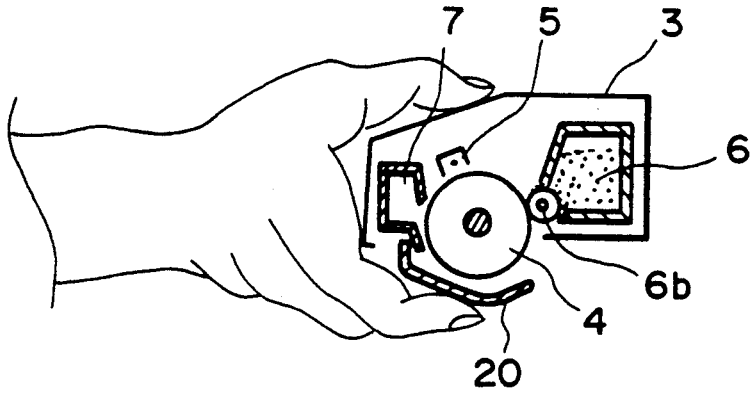
FIGS. 2A and 2B are views for explaining the background art for the present invention, where
Figure 2B:
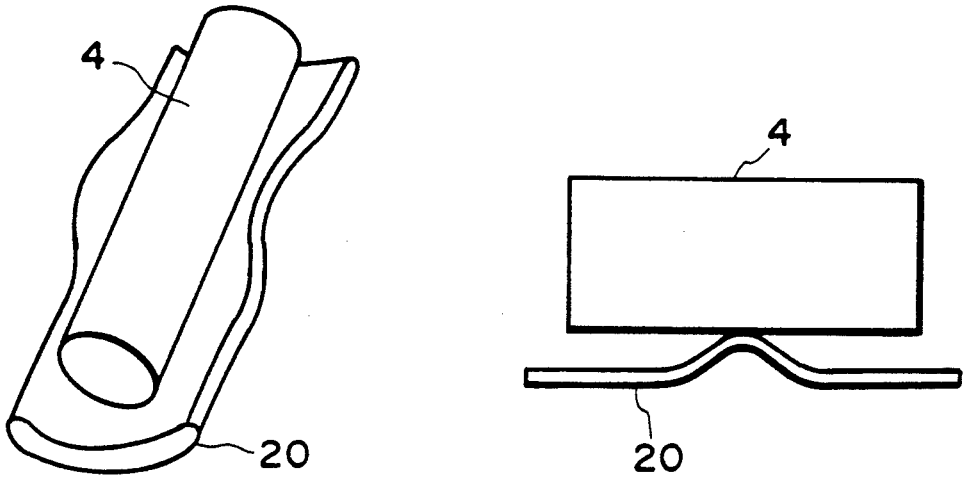
Figure 3:
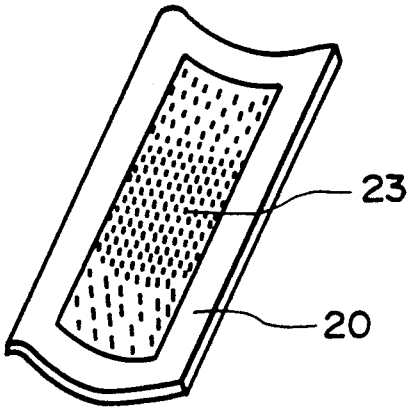
FIG. 3 is a perspective view of a drum shutter for explaining the background art for the present invention.

First of all, the frame 3a of the process cartridge 3 is inserted from the position shown in FIGS. 7A and 7B in a direction shown by the arrow V. As a result, a projection 40c of a movable link 40 for releasing the drum shutter (protection member) 20 is abutted against a fixed member 41 formed on the frame 2 of the printer. When the process cartridge 3 is further inserted into the frame 2, the link 40 is rotated about a pivot 40a, with the result that the drum shutter 20 is opened while being guided by links 42a, 42b disposed on both sides of the shutter. As shown in FIGS. 8A and 8B, when the process cartridge 3 is mounted in a predetermined mounting position, the shutter 20 is maintained in the open condition in the vicinity of the frame 3a near the cleaner (FIG. 1).

On the other hand, when the cartridge 3 is dismounted from the frame 2 of the printer, the cartridge is drawn in a direction opposite to the direction V. Meanwhile, when the movable link 40 is disengaged from the fixed member 41, the drum shutter 20 is returned to the closed position covering the transfer opening 3b of the frame 3a, by the biasing force of a spring 43 disposed on the pivot 40a. In this position, the shutter 20 is maintained in the closed position by abutting a portion 40d of the movable link 40 against the frame 3a by the biasing force of the spring 43.

Incidentally, in this embodiment, the movable link 40 is rotatably mounted on the frame 3a via the pivot 40a, and the other end of the movable link is rotatably connected to a lateral edge 20f of the shutter 20 via a pin 40b. Further, the links 42a, 42b are rotatably mounted at their one end 42c on the frame 3a, and are also rotatably connected at their other end 42d to the lateral edge 20f of the shutter 20.

Figure 9:
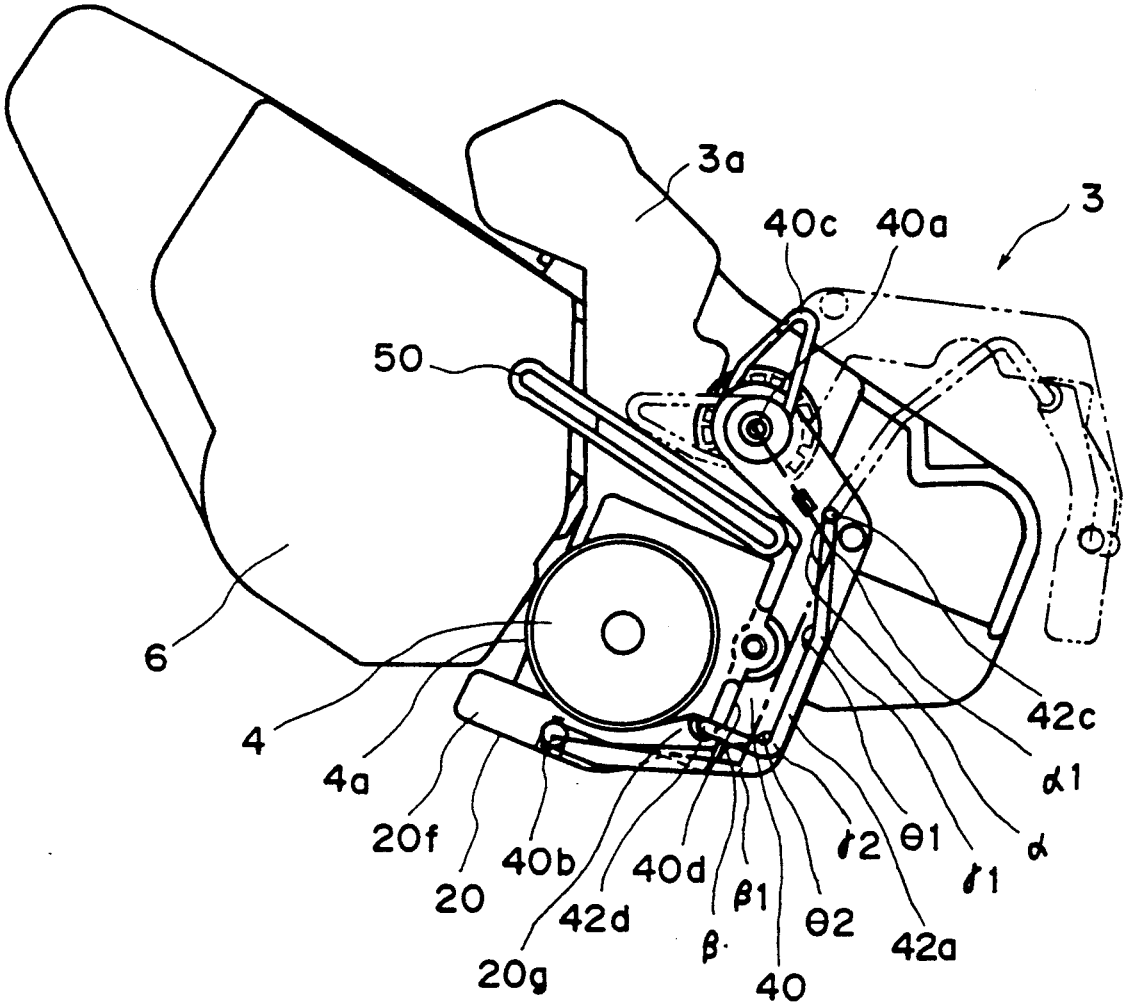
FIG. 9 is a side view of the process cartridge for explaining the operation thereof.

Now, the details of the process cartridge are shown in FIG. 9 as a side view. Incidentally, in FIG. 9, several positions of the drum shutter 20 transited from the closed position to the open position are also illustrated. The reference numeral 50 denotes a guide disposed outside the frame 3a for guiding the cartridge 3 in the mounting direction during the insertion of the cartridge.

As clearly seen in FIG. 9, the movable link 40 has a "convex" shape so that it encircles a right half of the photosensitive drum 4 and is pivotally mounted on the frame 3a via the pivot 40a, and the end of the link is rotatably connected to a central portion of the lateral edge 20f of the shutter 20 via the pin 40b. On the other hand, the link 42a has an end portion bent at a right angle, and a distal end of the bent portion is rotatably connected to the lateral edge 20f of the shutter 20 at a corner 20g of the end thereof to be opened. The end 42c of this link is pivotally mounted on the frame 3a. Incidentally, the attachment end 42c of the link 42a is disposed between the photosensitive drum 4 and the pin 40a for the movable link 40 in the vertical direction. Further, in the horizontal direction, the end 42c is disposed on the frame 3a outside the peripheral surface of the photosensitive drum 4 and the pivot 40a for the movable link 40.

By properly selecting the lengths of the movable link 40 and the links 42a, 42b, as shown in FIG. 9, the drum shutter 20 is opened along the proximity of the frame 3a near the cleaner 7 (not shown). Thus, in the process cartridge according to this embodiment, since the opening/closing movement of the shutter 20 is effected along the proximity of the frame 3*a*, it is possible to further reduce the cartridge mounting space in the frame 2 of the printer in comparison with the conventional case.

Figure 10A:
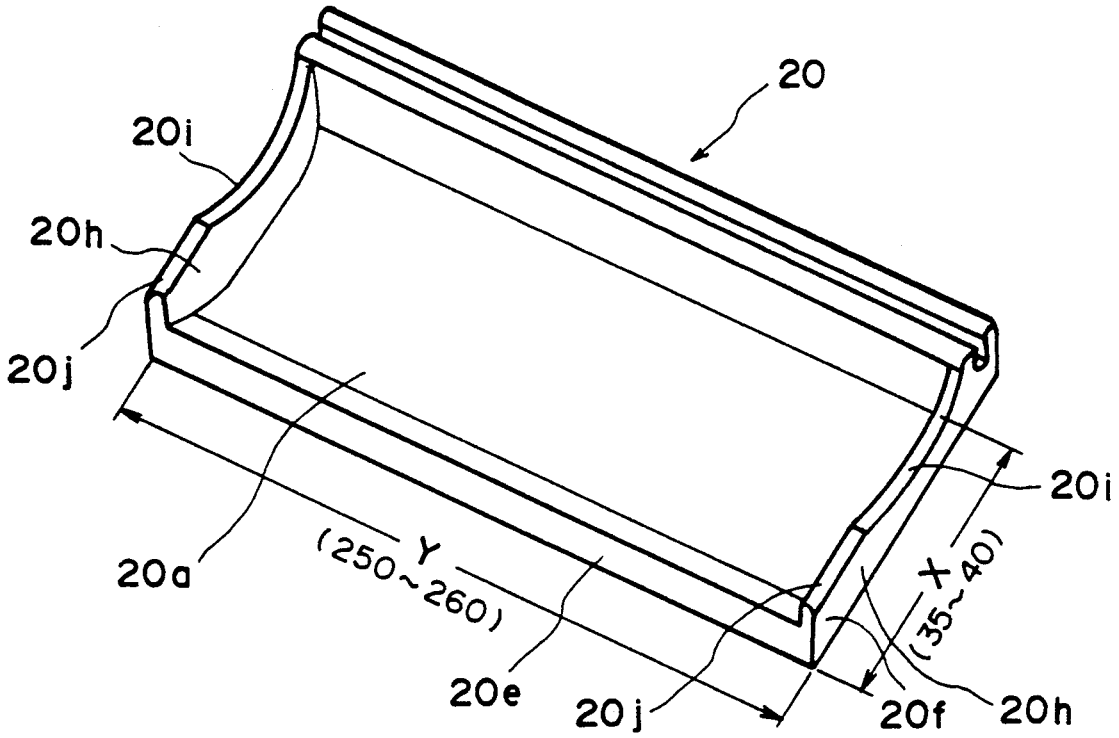
FIGS. 10A and 10B are perspective views of a drum shutter.
Figure 10B:
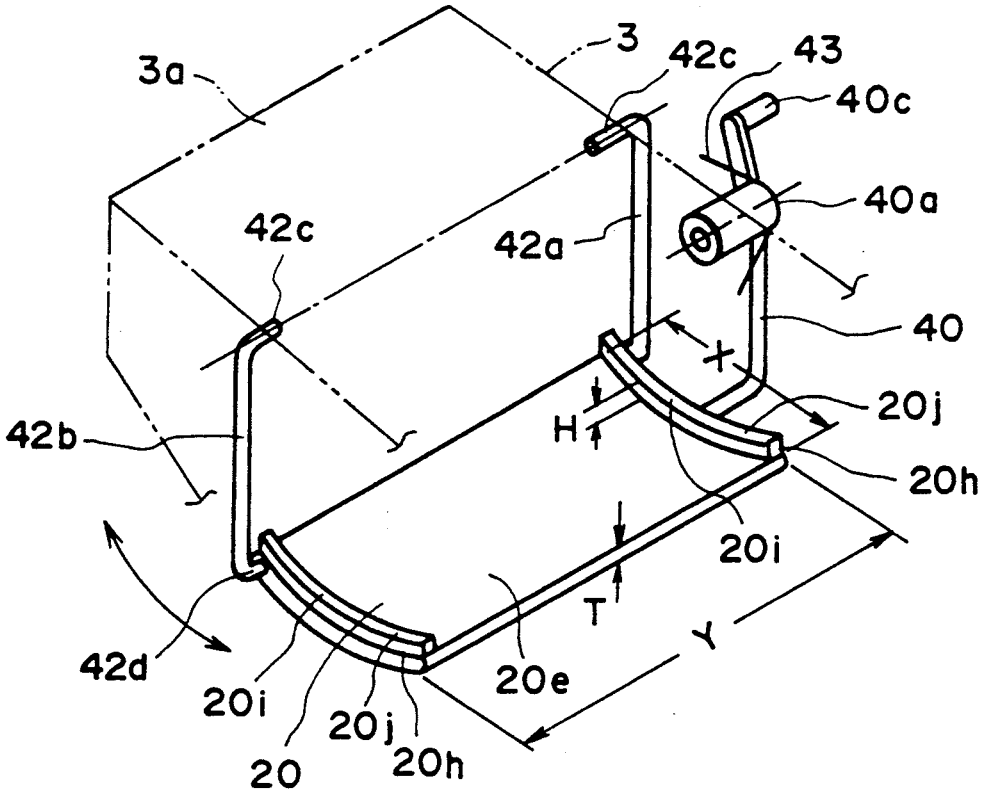

FIGS. 10A and 10B are perspective views of the above-mentioned shutter 20 (FIGS. 7, 8, 9). Incidentally, FIG. 10B is a perspective view of a shutter to which the links are attached.

In the shutter 20 according to this embodiment, vertical projections 20*h* are formed on lateral edges of a cover portion 20*a* of the shutter 20. Each projection 20*h* has a semi-cylindrical surface 20*i* which is adapted to be abutted against the drum 4, and a flat surface 20*j*. In this embodiment, when the shutter 20 is shifted from the open position to the closed position, the flat surfaces 20*j* of the projections 20*h* are firstly abutted against the peripheral surface of the drum 4. Then, the semi-cylindrical surfaces 20*i* of the projections 20*h* reach the peripheral surface of the drum 4 while being guided by the flat surfaces 20*j*, with the result that the shutter 20 is in the closed condition with the semi-cylindrical surface 20*i* of the projections mated with the peripheral surface of the drum 4. Now, the drum shutter 20 is molded from polystyrol resin similar to the frame 3*a*. Accordingly, also in this embodiment, the drum shutter 20, when closed, is positioned with respect to the peripheral surface of the drum 4 with high accuracy, and, thus, when the operator grasps the cartridge 3, even if the shutter 20 is flexed (normally, the shutter is subjected to a load of about 2 Kg), it is possible to prevent the surface of the photosensitive member 4*a* from being damaged by the flexed shutter 20. Further, when the shutter 20 is closed, since the projections 20*h* mate with the peripheral surface of the drum, the ability to protect the photosensitive member 4*a* can be further improved.

Now, the concrete dimensions of the shutter will be described hereinbelow. Incidentally, the following example is a case where the shutter 20 is used with a process cartridge capable of recording an image on a sheet having A4 size:

| | |
|---|---|
| (i) Width (X) of cover portion 20a | about 35–40 mm, |
| (ii) Length (Y) of cover portion 20a | about 250–260 mm, |
| (iii) Thickness (T) of cover portion 20a | about 1.5 mm, |
| (iv) Height (H) of projection 20h | about 5–6 mm, |
| (v) Material | polystyrol (molding), |
| (vi) Movable link 40: | |
| Length between pivot 40a and bent point $\alpha 1$ | about 18–23 mm, |
| Length between bent points $\alpha 1$ and $\beta 1$ | about 33–38 mm, |
| Length between bent point $\beta 1$ and attachment point 40b | about 28–33 mm, |
| Angle $\alpha$ | about 120 degrees, |
| Angle $\beta$ | about 105 degrees, |
| (vii) Link 42a: | |
| Length between attachment point 42c and bent point $\gamma 1$ | about 16–22 mm, |
| Length between bent points $\gamma 1$ and $\gamma 2$ | about 16–22 mm, |
| Length between bent point $\gamma 2$ and attachment point 42d | about 9–11 mm, |
| Angle $\theta 1$ | about 160 degrees, |
| Angle $\theta 2$ | about 90 degrees. |

Incidentally, while the process cartridges of the aforementioned embodiments had the charger, developing device and cleaner, as well as the photosensitive drum as the image bearing member, the process cartridge according to this embodiment may have at least the image bearing member, and preferably has at least one of a charger, developing device and cleaner. That is to say, the above-mentioned process cartridge incorporates therein an image bearing member (for example, electrophotographic photosensitive member and the like), and at least one of a charger means, developing means and cleaning means (as action means) as a unit which can be removably mounted within a image forming system. More specifically, the process cartridge incorporates therein a charger means, developing means or cleaning means, and an electrophotographic photosensitive member as a unit which can be removably mounted within an image forming system (for example, a copying machine, laser beam printer or the like); or incorporates therein at least one of a charger means, developing means and cleaning means, and an electrophotographic photosensitive member as a unit which can be removably mounted within an image forming system (for example, a copying machine, laser beam printer or the like); or incorporates therein at least a developing means and an electrophotographic photosensitive member as a unit which can be removably mounted within an image forming system (for example, a copying machine, laser beam printer or the like).

According to the above-mentioned embodiments, since the cover portion of the drum shutter for protecting the image bearing member, such as a photosensitive drum, is abutted against the non-imaging area of the photosensitive drum, or the flanges formed on the photosensitive drum, to position an former, even if the drum shutter is subjected to the excessive load, the image bearing surface of the photosensitive drum can be protected effectively.

As mentioned above, according to the present invention, it is possible to provide a process cartridge which can form an image with high quality without damaging an image bearing member, and an image forming system within which such process cartridge can be removably be mounted.

What is claimed is:

1. A process cartridge removably mountable to an image forming apparatus, comprising:

an image bearing member;

process means acting on said image bearing member;

a protection member shiftable between a protection position where said protection member protects said image bearing member and a retracted position where said protection member is retracted from said protection position; and contact means provided on a surface of said protection member which can face said image bearing member, said contact means being contactable with a non-image forming area of said image bearing member.

2. A process cartridge according to claim 1, wherein said contact means comprises a projection projecting toward said image bearing member more than a surface portion of said protection member which faces an image forming area of said image bearing member.

3. A process cartridge according to claim 1, wherein said contact means comprises projections provided on both lateral sides of said protection member along an opening/closing direction of said protection member.

4. A process cartridge according to claim 1, wherein said contact means projects from an inner surface of said protection member by about 3–7 mm, preferably about 4–6 mm and most preferably about 5.5 mm.

5. A process cartridge according to claim 1, wherein said image bearing member comprises a cylinder and a photosensitive member disposed on a peripheral surface of said cylinder, and said contact means contacts the peripheral surface portion of said cylinder which has no photosensitive member.

6. A process cartridge according to claim 1, wherein said image bearing member comprises a cylinder and a photosensitive member disposed on a peripheral surface of said cylinder, and said contact means contacts a non-image forming area of said photosensitive member.

7. A process cartridge according to claim 1, wherein said protection member is formed from high impact plastic resin.

8. A process cartridge according to claim 7, wherein said high impact plastic resin is polystyrol.

9. A process cartridge according to claim 1, wherein a thickness of said protection member is about 0.5–3 mm, preferably about 1–2 mm and most preferably about 1.5 mm.

10. A process cartridge according to claim 1, wherein said protection member is shiftably supported by a frame of the process cartridge via three arms.

11. A process cartridge according to claim 1, wherein said image bearing member is supported by a frame having a transfer opening for transferring a developed image on said image bearing member onto a recording medium, and said protection member covers said transfer opening when said protection member is in said protection position.

12. A process cartridge according to claim 1, wherein said protection member can be retracted toward a frame in which a cleaning means is disposed, by an arm pivotally mounted on said frame.

13. A process cartridge according to claim 1, wherein said image bearing member has an electrophotographic photosensitive member.

14. A process cartridge according to claim 1, wherein said process means includes developing means.

15. A process cartridge according to claim 1, wherein said process means includes charger means.

16. A process cartridge according to claim 1, wherein said process means includes cleaning means.

17. A process cartridge according to claim 1, wherein said process cartridge incorporates therein charger means, developing means or cleaning means as said process means, and an electrophotographic photosensitive member as said image bearing member as a unit which can be detachably mounted within said image forming apparatus.

18. A process cartridge according to claim 1, wherein said process cartridge incorporates therein at least one of charger means, developing means or cleaning means as said process means, and an electrophotographic photosensitive member as said image bearing member as a unit which can be detachably mounted within said image forming apparatus.

19. A process cartridge according to claim 1, wherein said process cartridge incorporates therein at least developing means as said process means, and an electrophotographic photosensitive member as said image bearing member as a unit which can be detachably mounted within said image forming apparatus.

20. An image forming apparatus for forming an image on a recording medium, comprising:

mounting means capable of mounting a process cartridge including an image bearing member, process means acting on said image bearing member, a protection member shiftable between a protection position where said protection member protects said image bearing member and a retracted position where said protection member is retracted from said protection position, and contact means provided on a surface of said protection member which can face said image bearing member, said contact means being contactable with a non-image forming area of said image bearing member; and conveying means for conveying said recording medium.

21. An image forming apparatus according to claim 20, wherein the image forming apparatus is a laser beam printer.

22. An image forming apparatus according to claim 20, wherein the image forming apparatus is an electrophotographic copying machine.

23. A process cartridge removably mountable within an image forming apparatus, comprising;

an image bearing member;

process means acting on said image bearing member;

a protection member shiftable between a protection position where said protection member protects said image bearing member and a retracted position where said protection member is retracted from said protection position; and contact means provided on a non-image forming area of said image bearing member and contactable with said protection member.

24. A process cartridge according to claim 23, wherein said contact means projects toward said protection member more than an image forming area of said image bearing member.

25. A process cartridge according to claim 23, wherein said contact means comprises a flange having a drum gear connected to a cylinder of said image bearing member.

26. An image forming apparatus for forming an image on a recording medium, comprising:

mounting means capable of mounting a process cartridge including an image bearing member, process means acting on said image bearing member, a protection member shiftable between a protection position where said protection member protects said image bearing member and a retracted position where said protection member is retracted form said protection position, and contact means provided on a non-image forming area of said image bearing member and contactable with said protection member; and conveying means for conveying said recording medium.

27. An image forming apparatus according to claim 26, wherein the image forming apparatus is a laser beam printer.

28. An image forming apparatus according to claim 26, wherein the image forming apparatus is an electrophotographic copying machine.

29. A process cartridge comprising at least an image bearing member and removably mountable to an image forming apparatus, characterized by a cover shiftable between a first position where said cover covers an exposed portion of said image bearing member and a second position where said cover is retracted from said first position;

wherein a position of said cover is regulated by abutting said cover against a non-image area of said image bearing member when said cover is in said first position.

30. A process cartridge comprising at least an image bearing member and removably mountable to an image forming apparatus, characterized by a cover shiftable between a first position where said cover covers an exposed portion of said image bearing member and a second position where said cover is retracted from said first position;

wherein a position of said cover is regulated by abutting said cover against a flange connected to said image bearing member when said cover is in said first position.

31. A process cartridge according to claim 30, wherein said flange has a gear portion for transmitting a driving force.

32. A process cartridge according to claim 29, further including at least one of charger means, developing means and cleaning means which act on said image bearing member.

33. A process cartridge according to claim 30, further including at least one of charger means, developing means and cleaning means which act on said image bearing member.

34. A process cartridge according to claim 31, further including at least one of charger means, developing means and cleaning means which act on said image bearing member.

* * * * *

UNITED STATES PATENT AND TRADEMARK OFFICE

CERTIFICATE OF CORRECTION

PATENT NO. : 5,266,999

DATED : November 30, 1993

INVENTOR(S) : Masahiko Yashiro

It is certified that error appears in the above-indentified patent and that said Letters Patent is hereby corrected as shown below:

COLUMN 1:

line 25, "and," should read --and--.
line 30, "photo" should read --photosensitive--.
line 36, "Inventors" should read --The inventors--; and "the" should be deleted.
line 65, "the" (first occurrence) should be deleted.

COLUMN 3:

line 12, "which an" should read --which utilizes an--.
line 52, "regist" should read --registration--.

COLUMN 4:

line 5, "with" (first occurrence) should be deleted.
line 6, "facing." should read --facing down.--.
line 57, "ar e" should read --are--.
line 59, "an" should read --and--.

UNITED STATES PATENT AND TRADEMARK OFFICE

CERTIFICATE OF CORRECTION

PATENT NO. : 5,266,999

DATED : November 30, 1993

INVENTOR(S) : Masahiko Yashiro

It is certified that error appears in the above-indentified patent and that said Letters Patent is hereby corrected as shown below:

COLUMN 5:

line 4, "nonphotosensitive" should read --non-photosensitive-

COLUMN 6:

line 20, "cleaner (FIG. 1)." should read --cleaner 7 (FIG. 1)--.

COLUMN 8:

line 41, "be" should be deleted.

COLUMN 10:

line 49, "form" should read --from--.
line 68, "position;" should read --position,--.

UNITED STATES PATENT AND TRADEMARK OFFICE

CERTIFICATE OF CORRECTION

PATENT NO. : 5,266,999

DATED : November 30, 1993

INVENTOR(S) : Masahiko Yashiro

It is certified that error appears in the above-indentified patent and that said Letters Patent is hereby corrected as shown below:

Column 11:

line 11, "position;" should read --position,--.

Signed and Sealed this

Second Day of August, 1994

*Attest:*

*Attesting Officer*

BRUCE LEHMAN

*Commissioner of Patents and Trademarks*